US006076618A

United States Patent [19]

Åsberg

[11] Patent Number: 6,076,618

[45] Date of Patent: Jun. 20, 2000

[54] ROCK DRILLING TOOL WITH RADIALLY EXTENDABLE TWO-PIECE REAMER

[75] Inventor: Bengt Åsberg, Åshammar, Sweden

[73] Assignee: Sandvik AB, Sandviken, Sweden

[21] Appl. No.: 09/131,419

[22] Filed: Aug. 10, 1998

[51] Int. Cl.[7] ..... E21B 10/32

[52] U.S. Cl. ..... 175/385; 175/391

[58] Field of Search ..... 175/385, 386, 175/387, 389, 390, 391, 395, 407, 414

[56] References Cited

U.S. PATENT DOCUMENTS

| | | | |
|---|---|---|---|
| 5,009,271 | 4/1991 | Maric et al. | 175/53 |
| 5,040,621 | 8/1991 | Lof | 175/258 |
| 5,259,469 | 11/1993 | Stjernstrom et al. | 175/385 |
| 5,284,216 | 2/1994 | Brungs et al. . | |

*Primary Examiner*—William Neuder
*Assistant Examiner*—Elaine Gort
*Attorney, Agent, or Firm*—Burns, Doane, Swecker & Mathis, L.L.P.

[57] ABSTRACT

A rock drilling tool includes a drill body on which a radially extendible reamer is mounted. The reamer, when extended, enlarges the hole diameter to enable a hole casing to be pulled down by the tool. The body includes a front pilot bit, a rear shank adapted to be connected to a drill string, and a guiding member disposed between the pilot bit and the rear shank for pulling the hole casing along with the tool. The pilot bit, the rear shank and the guiding member are non-removable from one another. The reamer, which is mounted between the guiding member and the pilot bit, is formed of two U-shaped pieces that are hinged together to enable the reamer to be installed and removed.

12 Claims, 8 Drawing Sheets

ROCK DRILLING TOOL WITH RADIALLY EXTENDABLE TWO-PIECE REAMER

BACKGROUND OF THE INVENTION

The present invention relates to a rock drilling tool, comprised of a drill body and a reamer mounted thereon for radial extension and retraction.

In known drilling tools of the above-mentioned type, drawbacks result from screw thread connections, for example between the guiding means and the part which carries the reamer, because there always occur energy losses in threaded joints which transfer impact energy.

Another known tool is shown in applicant's U.S. Pat. No. 5,284,216 wherein the shank and the drill bit constitute an entity on which a guide is arranged. However it has been experienced that the known tool comprises a number of drawbacks; the reamer cannot easily be exchanged, the impact energy cannot be maximally utilized, the position of the grooves cannot be placed optimally, and locking means for threads has poor strength and is troublesome to handle.

OBJECTS OF THE INVENTION

One object of the present invention is to provide a rock drilling tool eliminating the above-captioned drawbacks.

Another object of the present invention is to provide a rock drilling tool wherein the reamer easily can be mounted and dismounted.

Still another object of the present invention is to provide a rock drilling tool wherein an optional reamer can be used.

SUMMARY OF THE INVENTION

The objects and advantages of the invention are achieved by a drilling tool for down-the-hole drilling and for pulling a hole casing downwardly. The drilling tool comprises a drill body defining a longitudinal central axis and including a front pilot bit, a rear shank, and a guide member disposed between the pilot bit and the rear shank. The guide member includes a forwardly facing surface adapted to pull a hole casing forwardly. The pilot bit, the rear shank, and the guide member are non-removable from one another. A reamer is mounted on the body axially between the pilot bit and the guide member. The reamer has an inner diameter which is smaller than largest diameters of the guide member and the pilot bit, respectively. The reamer comprises a plurality of pieces forming respective circumferential portions of the reamer.

Preferably, the reamer pieces are separable to permit the reamer to be removed from the body. There are preferably two reamer pieces each extending substantially 180°, and the pieces are hinged together for rotation about an axis extending parallel to the central axis.

The present invention also pertains to the drill body per se which is adapted to carry the reamer.

SHORT DESCRIPTION OF THE DRAWINGS

A preferred embodiment of the invention is described with reference to the enclosed drawings, where FIG. 1A schematically shows a body element according to the present invention in a perspective view, with a reamer removed;

Figure 2A:
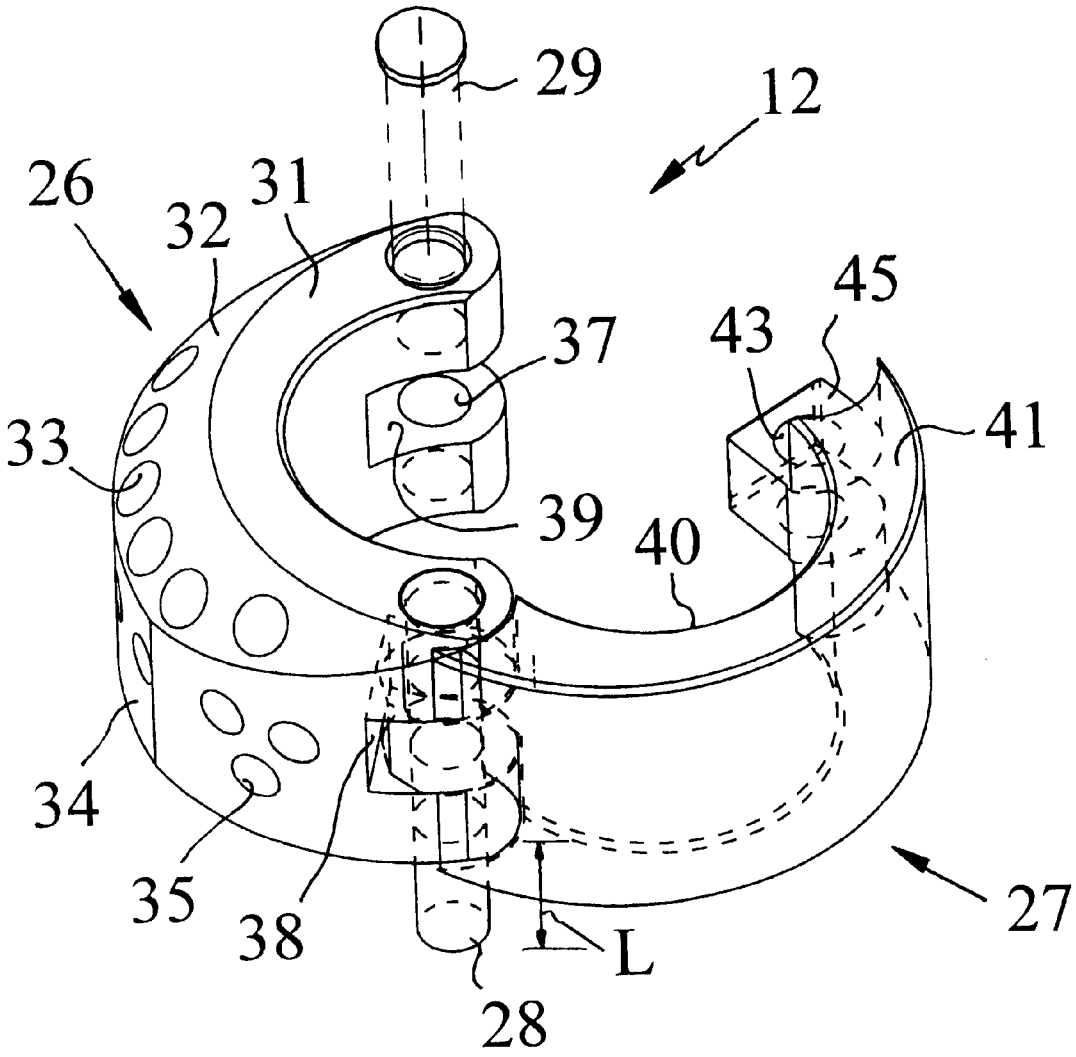
Figure 2B:
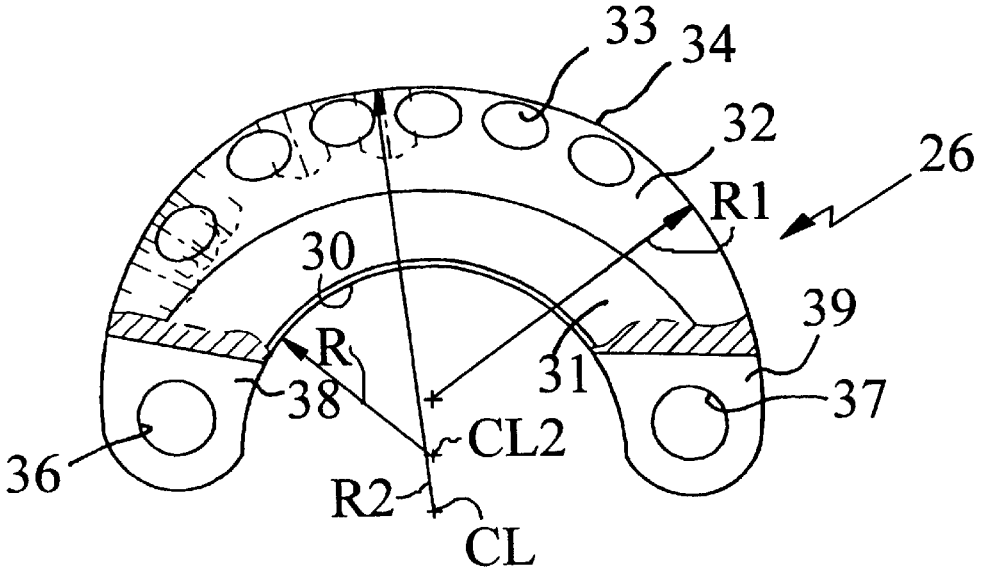
Figure 2C:
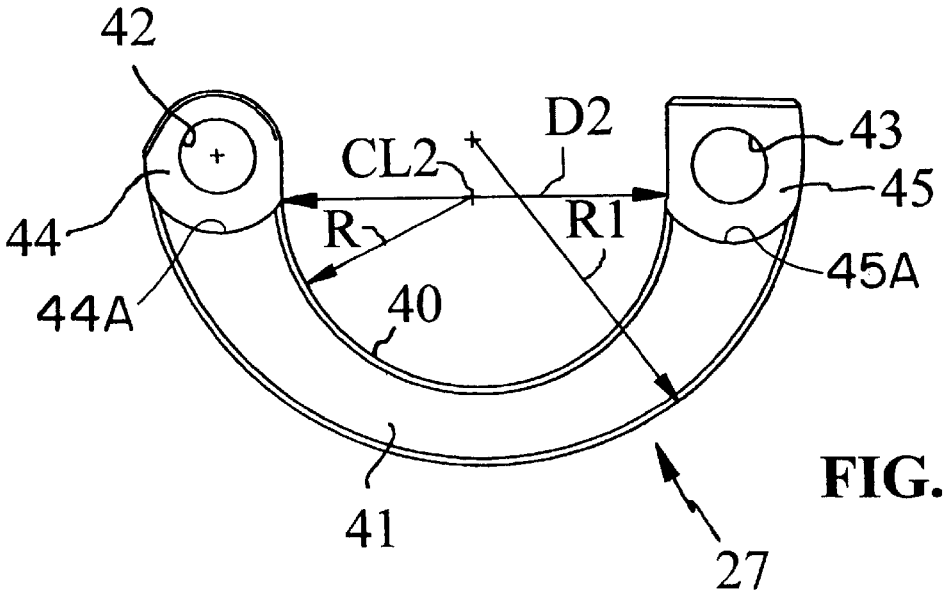
Figure 3:
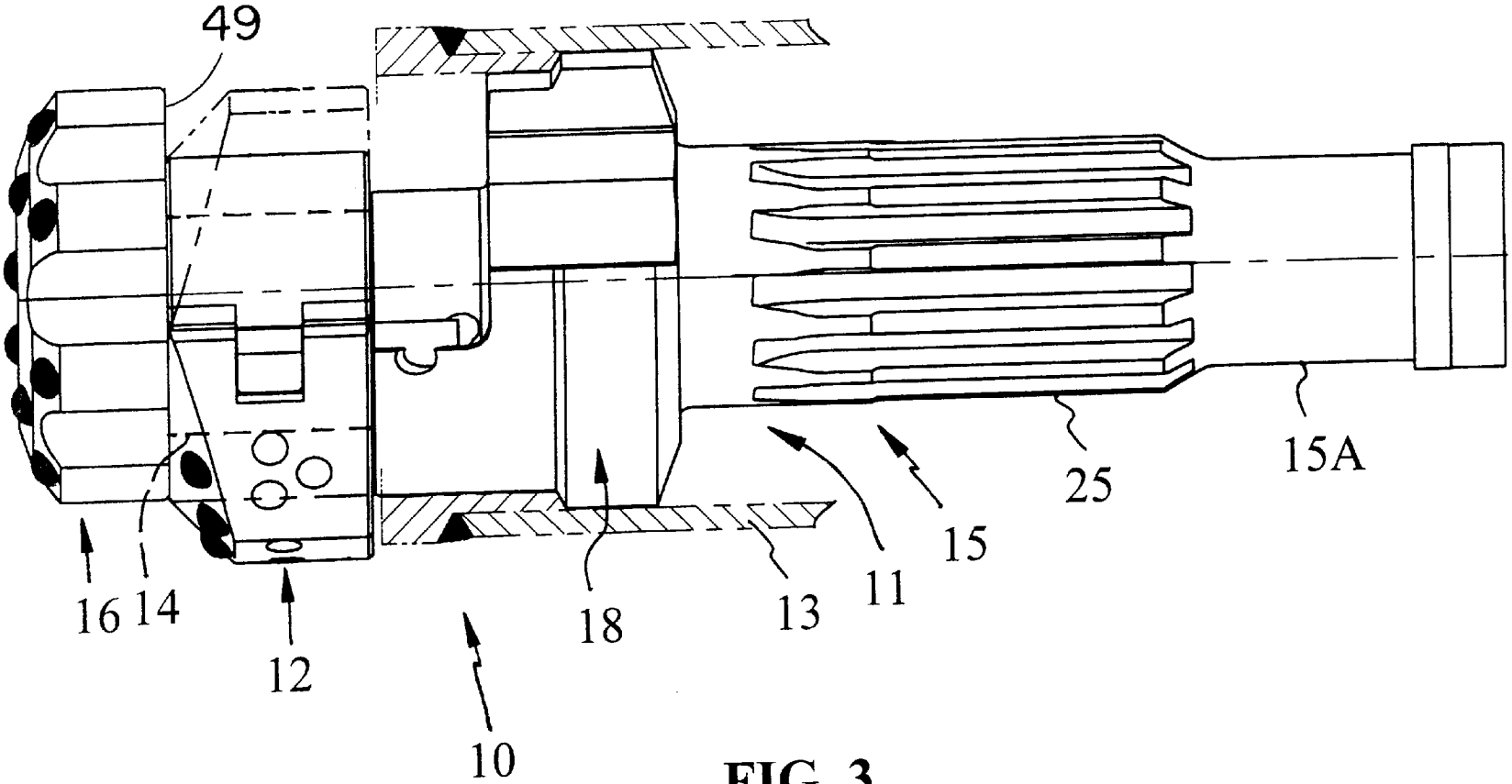
Figure 4A:
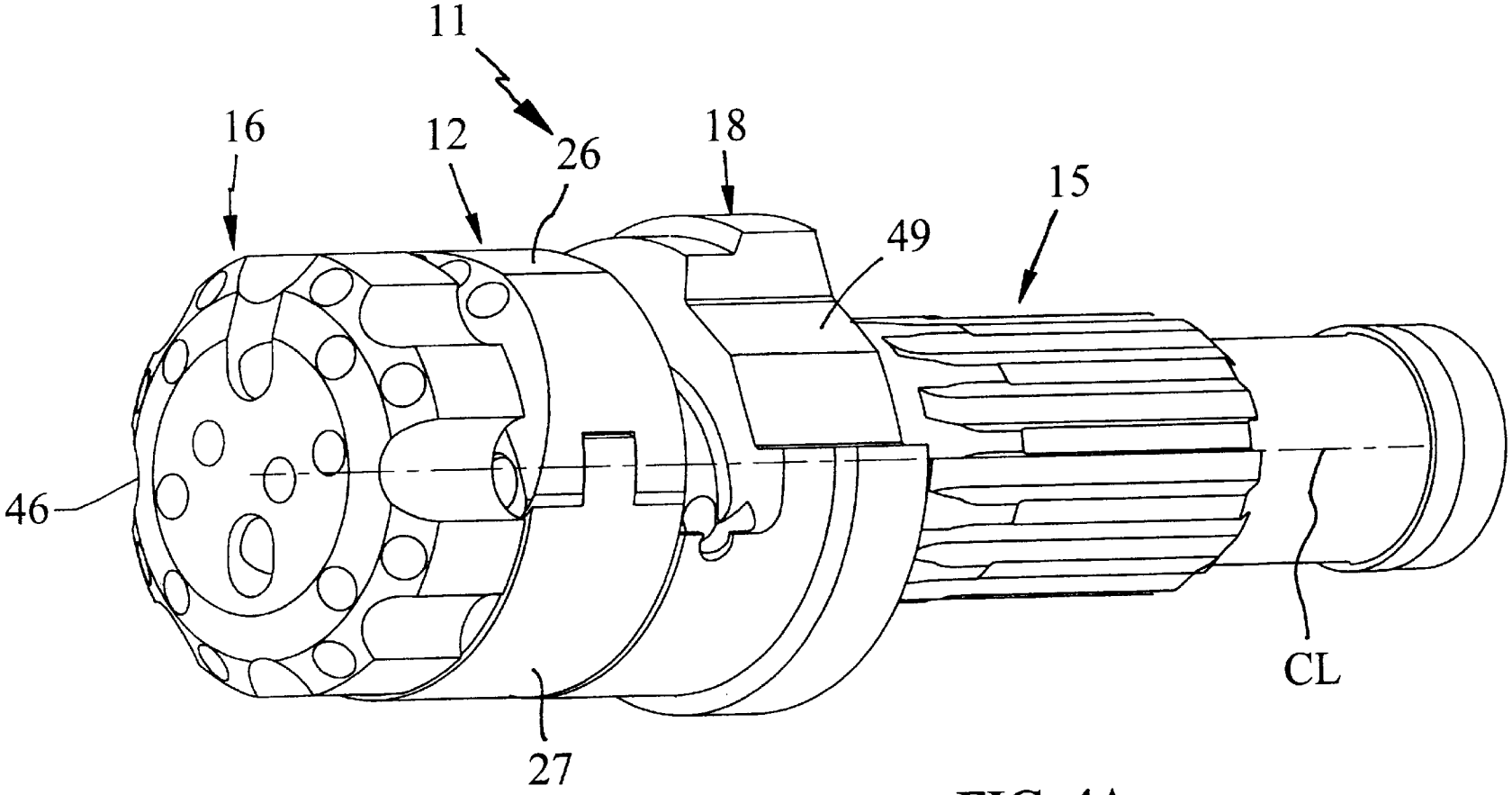
Figure 4B:
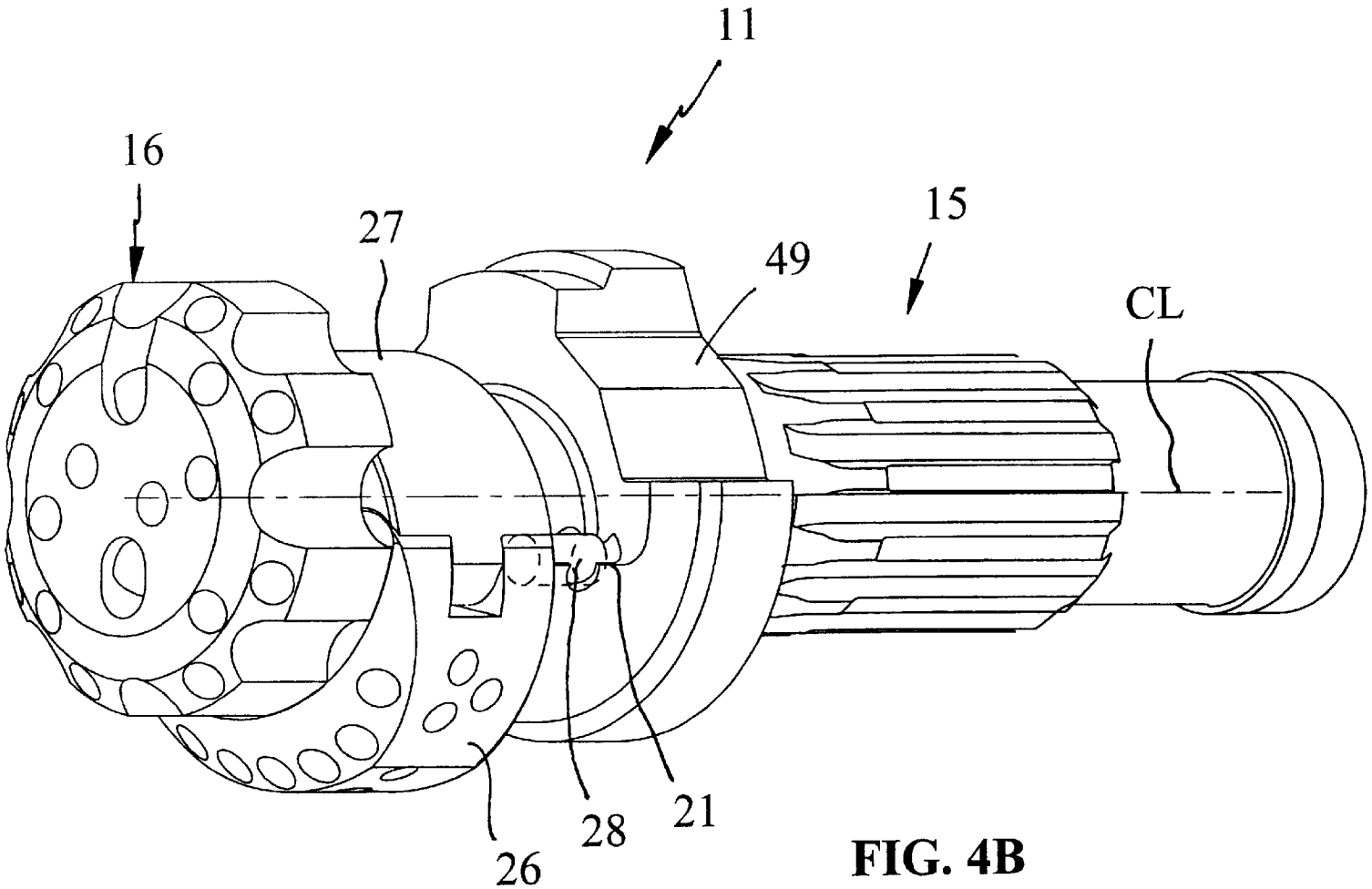
Figure 5:
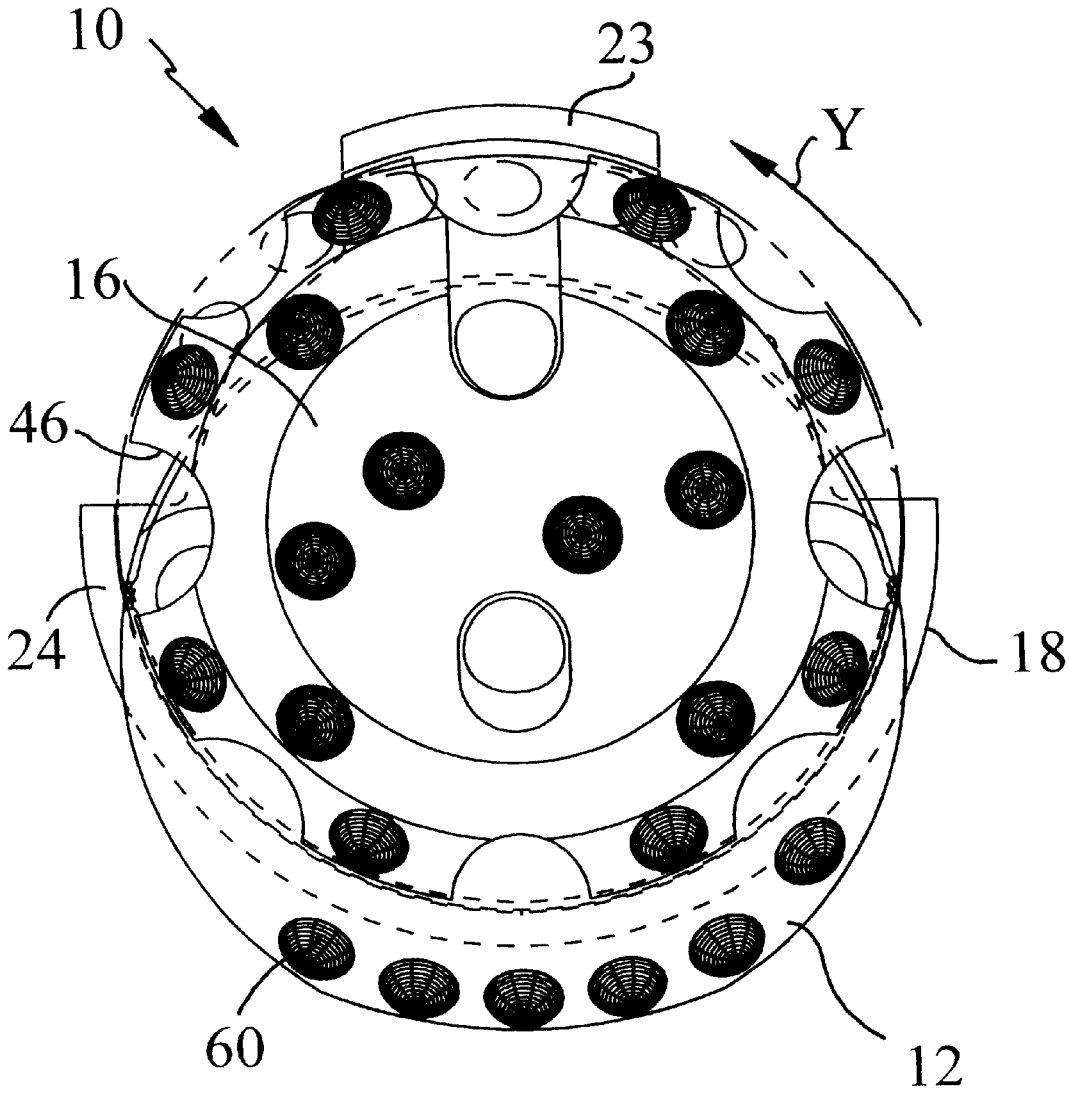

FIG. 2A schematically shows a reamer according to the present invention in a perspective view, the reamer being open;

FIG. 2B and 2C schematically show respective parts of the reamer in plan views, partly in section;

FIG. 3 schematically shows a partly sectioned, side view of a rock drilling tool according to the present invention, with the reamer radially extended;

FIG. 4A and 4B show perspective views of the rock drilling tool with the reamer extended and retracted, respectively; and FIG. 5 shows a front end view of the rock drilling tool with the reamer in an extended position.

DETAILED DESCRIPTION OF A PREFERRED EMBODIMENT OF THE INVENTION

The rock drilling tool 10 according to the present invention comprises a drill body element 11 and a reamer 12, (see FIG. 3). In a known manner, the reamer 12 can be radially extended to a drilling or operative mode, to expand a hole and allow a hole casing 13 to be displaced downwardly together with the drilling tool. By rotating the drilling tool around its rotational center axis CL in a direction opposed to its operative direction there will occur limited relative rotation between the reamer 12 and an eccentric bearing portion 14, whereby the reamer is radially retracted to an inactive position, which enables the drilling tool to be retracted, up through the casing 13. The bearing portion 14, which is substantially cylindrical with a diameter D3, has a rotational or center axis CL2 which is parallel to and eccentrically placed relative to the axis CL and carries the reamer 12. The reamer has at least partly a varying wall thickness along its circumference and has an internal smallest diameter D2 of the same order of magnitude as the diameter D3. The rock drilling tool consequently has a bigger diameter in the reamer-operative mode than in the reamer-inactive mode.

Figure 1A:
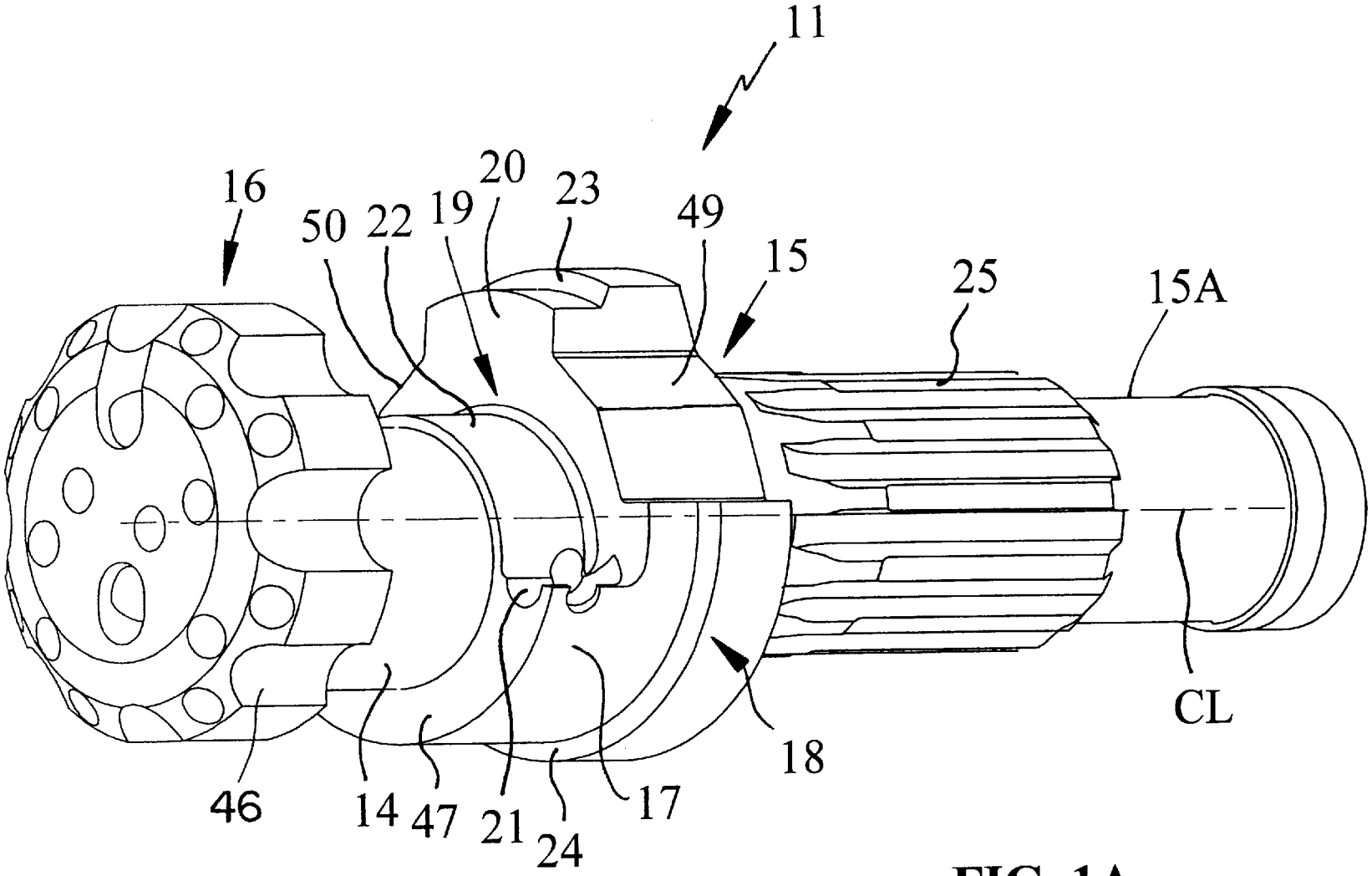
FIG. 1B shows a cross-section through an eccentric portion of the body element.
FIG. 1C is a front end view of the body element.
Figure 1B:
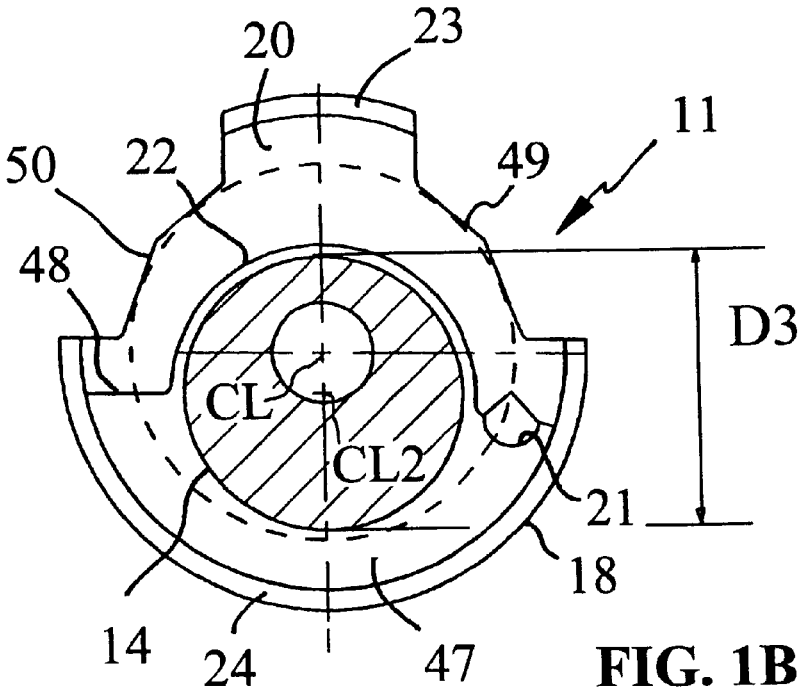
Figure 1C:
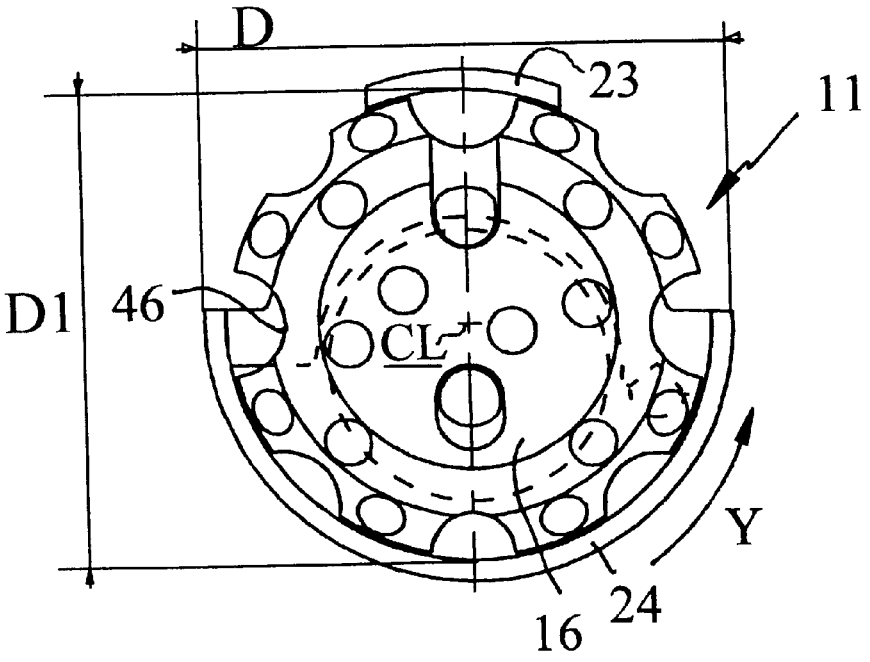

The drill body element 11 according to the present invention is separately shown in FIGS. 1A–1C. The drill body element 11 comprises a shank 15, a central pilot bit 16 and a guide 18, wherein the shank, the pilot bit and the guiding means constitute an integral one-piece unit, whereby they are not releaseable from each other. The pilot bit 16 comprises an array of buttons 60 of cemented carbide (FIG. 5), possibly diamond coated, defined by a largest diameter D1. The guiding means 18 is defined by a largest diameter D and comprises a front driving portion 17, which is provided in connection with the shank 15. The driving portion 17 is eccentrically provided relative to the rest of the shank 11, and the guiding means 18 has a substantially corresponding eccentrical recess 19 at opposite sides relative to the central axis CL. The eccentrical recess 19 is bordered radially inwardly by a semi-cylindrical portion 22 and axially rearwardly by an essentially planar surface 20. A support surface 47 running around the bearing portion 14 is provided as an axial forward end of both the portion 22 and the driving portion 17. The support surface is perpendicular to the rotational axis CL. The portion 22 and the surface 20 connect to each other. A seat 21 for driving the reamer is provided at one circumferential end of the portion 22, i.e. at the trailing end in the rotational direction Y. A second end 48 is provided at the part of the portion 22 which comes first in the rotational direction Y. A system of flush channels is arranged in the body element, whereof one channel terminates in the seat 21 in order to rinse the seat and thereby guarantee a simple inwards pivoting of the reamer.

The guiding means 18 is provided with two external shoulders 23, 24 facing longitudinally forwardly which cooperate with a longitudinally rearwardly facing internal ledge on the casing 13 (see FIG. 3). The shoulders 23, 24 are somewhat conical in the direction of drilling as well as semi-circular in the direction of rotation. Through such an arrangement the casing 13 can be forced in the direction of drilling via impacts from the drilling tool when the drilling tool is displaced forwardly.

The guiding means 18 has two circumferential interruptions which form external flush channels 49, 50, that space the shoulders 23, 24 from each other. Alternatively, the flushing channels can be arranged as flushing holes disposed radially inside of an outer circumference of a continuous (uninterrupted) guiding means 18. Then only one contiguous casing-pulling shoulder would be present.

The shank 15 is provided with external longitudinal splines 25 which are adapted for engagement with internal splines of a down-the-hole hammer, not shown. The down-the-hole hammer transfers rotation to the rock drilling tool via these splines. The shank 11 has a cylindrical portion 15A of reduced diameter at its rear end, said portion 15A allowing the shank 15 to move axially a limited distance relative to the down-the-hole hammer.

In FIGS. 2A, 2B and 2C the reamer 12 is shown, which in the preferred the embodiment consists of four portions, namely a button housing 26, a shackle 27 pivoted to the button housing, and two pins 28, 29.

The button housing 26 is generally U-shaped. The button housing has an inner, semi-cylindrical bearing surface 30, which interconnects upper and lower surfaces 31, oriented substantially perpendicular to the rotational axis CL of the drill. The bearing surface 30 is defined by a radius R, the center of which always lies on the central axis CL2 of the bearing portion 14. The upper and lower surfaces 31 connect to an inclined or substantially conical surface 32. The conical surface comprises a number of peripherally placed holes 33 for receiving buttons of cemented carbide. The buttons may be diamond coated. The surface 32 further connects to a jacket surface 34, which in the embodiment is defined by two different radii R1 and R2. The center of the radius R2 coincides with the rotational axis CL in the reamer-installed position, while the center of the radius R1 is arranged radially outside said rotational axis CL in the reamer-installed position. The radius R1 defines the jacket surface of end legs of the U-shape, while the radius R2 defines the mid portion of the button housing. The radius R1 is smaller than the radius R2. In a part of the jacket surface 34 which lies first in the direction of rotation, i.e., a rotational leading part, holes 35 are formed for receiving buttons of cemented carbide in order to minimize steel wash-out. The button housing has rounded free ends. Through-holes 36, 37 are provided in the proximity of both free ends of the button housing, and are parallel with the rotational axis CL. Recesses or slots 38, 39 are provided in respective free ends, which slots run inwardly from respective free ends of the button housing a distance past the hole 36 or 37.

The shackle 27 is likewise generally U-shaped. The shackle has an inner, semi-cylindrical bearing surface 40, interconnecting upper and lower surfaces 41, which are essentially perpendicular to the axis of rotation CL of the drill. The bearing surface 40 is defined by a radius R identical to the radius for the bearing surface 30. The shackle preferably has no buttons. Through-holes 42, 43 are provided in respective free ends of the shackle and are parallel with the rotational axis CL. The holes 42, 43 are formed in lips 44, 45 provided at respective free ends of the shackle. The lips extend from respective free ends of the shackle for a distance past the respective holes 36, 37. The thickness of each lip is somewhat less than the width of the associated slot 38, 39. Each lip is surrounded by a semi-cylindrical, concave surface 44A, 45A corresponding in curvature to that of a rounded associated free end of the button housing. The lip 44 is to be inserted into the slot 38 for forming a hinge mounting. The lip 44 has a rounded free end while the lip 45, which is to be inserted into the slot 39, has a planar free end.

The rock drilling tool 10 is assembled in the following manner, foremost with reference to FIGS. 2A–2C and 4A. Firstly the lip 44 of the shackle 27 is brought into the slot 38 of the button housing such that the holes 36 and 42 become aligned. Then the pin 28 is inserted through the holes 36, 42 such that one end of the pin lies substantially flush with an associated pair of the surfaces 31 and 41. Said one end may include a head for axial positioning. The pin 28 is longer than the thickness of the hinge being formed, and its other end projects therepast for an axially rearward distance L. The button housing and the shackle are thereby pivotably joined. Subsequently they are brought, in an open condition (see FIG. 2A), towards the body element 11, and are placed thereon in an inactive position. Then, the shackle parts are swung closed so that the bearing surface 30 abuts the bearing portion 14 of the body element.

Subsequently the reamer is rotated around the bearing portion 14 until the holes 37 and 43 become longitudinally aligned with one of the grooves 46 formed in the pilot bit for conducting cuttings. The pin 29 is then inserted through the groove 46 and into in the aligned holes 39 and 43. One end of the pin 29 comprises a head for axial positioning. The pin 29 is not longer than the thickness of the formed ring-shaped reamer, and therefore its other end does not project from the reamer. The button housing and the shackle are thereby locked to each other around the eccentric bearing portion 14. Thereby the position of the reamer according to FIG. 4A has been achieved, i.e. the reamer is eccentrically positioned relative to the rotational axis CL and can bear axially against either a forwardly facing support surface 47 of the driving portion 17 or a rearwardly facing shoulder 49 of the drill bit 16. The reamer 12 has an inner diameter D2 which is smaller than both the largest diameter D of the guiding means 18 and the diameter D1 of the pilot bit 16. The inner diameter D2 of the reamer is somewhat bigger than the largest diameter D3 of the bearing portion 14.

In its mounted position the reamer 12 covers the bearing portion 14 and, as stated above, the reamer 14 is rotatable for a limited angle relative to the bearing portion 13. The angle in which the reamer is permitted to rotate is defined by the projection L of the pin 28 and the end positions 21 and 48 of the driving portion 17. The angle is about 180°.

Alternatively the pin 28 and seat 21 could be replaced by two axially extending planar shoulder surfaces on the button housing and the driving portion 17.

The drilling tool is thereby ready for mounting to a down-the-hole hammer for further transport through the casing against a casing shoe on the casing 13 whereafter drilling can be initiated in a known manner. When the drilling tool begins to drill, the reamer will, due to friction against the drilled hole, rotate relative to the body element and thereby be extended radially outwardly (see the solid lines in FIG. 3), until the pin 28 abuts against the seat 21, whereby further relative rotation is stopped.

When the rotation of the drill tool is reversed, the reamer is radially retracted until the pin 28 abuts against the end surface 48, whereby the drilling tool is radially retracted see the broken lines in FIG. 3.

The flushing channels 49, 50 are arranged on the same side of a plane oriented normal to the rotational axis CL, i.e. on the side wherein the shackle 27 is arranged in operative position. Thereby the reamer will not cover the flushing channels in the operative position, so a good transport of drill cuttings is attained.

Since the reamer 12 normally wears out much faster than the body element 11 or bit 16, it is necessary to periodically exchange the reamer. In such case the reamer 12 is easily dismounted in an inverted sequence compared to what has been described above.

In certain cases a bigger reamer may be needed, e.g., when a larger-diameter casing 13 is being inserted. Until now the user has been forced to purchase a bigger drilling tool, but with the present invention it is only necessary to store a bigger reamer, as well as an intermediate ring (not shown) for transferring impacts to the larger casing 13. In that case the intermediate ring would be situated axially between the reamer and the guiding means.

In the above-described embodiment, the guiding means and the pilot bit constitutes an integral unit. However, it would also be possible within the inventive idea to have an arrangement where the guiding means, the shank and the pilot bit constitute separate parts connected to each other for example by friction welding, i.e. the compounded unit has a design and function corresponding to an integral one-piece unit and the parts of the unit cannot be released from one another.

In a drilling tool according to the present invention the reamer can be easily exchanged. Further, the impact energy applied to the drill bit 16 is used to the maximum since this energy does not need to be transmitted by threads, but rather is transmitted by means of solid bodies. Consequently the need for locking means for threads is avoided. Another advantage is that the cuttings-conducting grooves can be located optimally such that the removal of cuttings is not hindered.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drilling tool for down-the-hole drilling and for pulling a hole casing downwardly, the drilling tool comprising:

a drill body defining a longitudinal central axis and including a front pilot bit, a rear shank, and a guide member disposed between the pilot bit and the rear shank, the guide member including a forwardly facing surface adapted to pull a hole casing forwardly, wherein the pilot bit, the rear shank, and the guide member are non-removable from one another; and a reamer mounted on the body axially between the pilot bit and the guide member and having an inner diameter smaller than largest diameters of the guide member and the pilot bit respectively, the reamer comprising a plurality of pieces forming respective circumferential portions of the reamer.

2. The drilling tool according to claim 1 wherein the reamer pieces are separable to permit the reamer to be removed from the body.

3. The drilling tool according to claim 2 wherein the reamer comprises two pieces, each piece extending substantially one hundred eighty degrees.

4. The drilling tool according to claim 3 wherein the two pieces are hinged together for rotation about an axis extending parallel to the central axis.

5. The drilling tool according to claim 4 wherein the drill body includes an eccentric portion on which the reamer is mounted for limited rotation relative thereto, the eccentric portion adapted to radially extend and retract the reamer in response to relative rotation therebetween.

6. The drilling tool according to claim 3 wherein each of the pieces is U-shaped.

7. The drilling tool according to claim 4 wherein only one of the pieces carries cutting elements.

8. The drilling tool according to claim 7 wherein the drill body further includes a driver portion axially disposed between the reamer and the guide member; a hinge connection between the reamer pieces formed by a pin extending parallel to the center axis and extending axially past the reamer and into a path of rotation of the driver portion to be engaged thereby for rotating the reamer.

9. The drilling tool according to claim 1 wherein the pilot bit, the rear shank, and the guide members are of integral, one-piece construction.

10. The drilling tool according to claim 1 wherein the pilot bit, the rear shank, and the guide member are welded together.

11. A drill body in combination with a radially extendible reamer for down-the-hole drilling, and for pulling a hole casing downwardly; the drill body defining a longitudinal center axis and including a front pilot bit, a rear shank, a guide member disposed between the pilot bit and rear shank, and an eccentric bearing portion disposed between the guide member and the pilot bit; the bearing portion configured to support the reamer, wherein the reamer is removably mounted wherein the pilot bit, the rear shank, and the guide member are non-removable from one another; the bearing portion having an external diameter smaller than largest diameters of the guiding member and the pilot bit, respectively.

12. The drill body according to claim 11 wherein the eccentric portion is non-removable from the pilot bit, the rear shank, and the guide member.

* * * * *

UNITED STATES PATENT AND TRADEMARK OFFICE

CERTIFICATE OF CORRECTION

PATENT NO. : 6,076,618
APPLICATION NO. : 09/131419
DATED : June 20, 2000
INVENTOR(S) : Åsberg It is certified that error appears in the above-identified patent and that said Letters Patent is hereby corrected as shown below:

On Title page, item (30) Foreign Application Priority Data:

"Aug. 8, 1997 (SE) 9702898-9" should be inserted

Signed and Sealed this

Twenty-fifth Day of July, 2006

JON W. DUDAS
*Director of the United States Patent and Trademark Office*